US006716078B1

(12) United States Patent
Stainer et al.

(10) Patent No.: US 6,716,078 B1
(45) Date of Patent: Apr. 6, 2004

(54) FIELD EMISSION DISPLAY AND METHOD OF MANUFACTURE

(75) Inventors: Matthew Stainer, Phoenix, AZ (US); Shawn M. O'Rourke, Tempe, AZ (US); Kazuo Kato, Aichi (JP); Susumu Sakamoto, Fukuoka (JP)

(73) Assignee: Motorola Inc., Schaumburg, IL (US)

( * ) Notice: Subject to any disclaimer, the term of this patent is extended or adjusted under 35 U.S.C. 154(b) by 628 days.

(21) Appl. No.: 09/626,979

(22) Filed: Jul. 27, 2000

(51) Int. Cl.[7] ..... H01J 9/227
(52) U.S. Cl. ..... 445/24; 313/582; 427/68
(58) Field of Search ..... 445/24; 427/68

(56) References Cited

U.S. PATENT DOCUMENTS

| | | | | |
|---|---|---|---|---|
| 5,477,105 A | | 12/1995 | Curtin et al. | |
| 5,543,683 A | * | 8/1996 | Haven et al. | 313/461 |
| 5,576,596 A | | 11/1996 | Curtin et al. | |
| 5,589,731 A | | 12/1996 | Fahlen et al. | |
| 5,670,296 A | | 9/1997 | Tsai | |
| 5,725,787 A | | 3/1998 | Curtin et al. | |
| 5,818,162 A | | 10/1998 | Drumm | |
| 5,858,619 A | | 1/1999 | Chang et al. | |
| 5,945,780 A | | 8/1999 | Ingle et al. | |
| 5,952,782 A | * | 9/1999 | Nanto et al. | 313/584 |
| 6,030,269 A | * | 2/2000 | Drumm | 445/52 |
| 6,103,452 A | * | 8/2000 | Kakinuma et al. | 430/281.1 |
| 6,249,264 B1 | * | 6/2001 | Sano et al. | 345/60 |
| 6,482,575 B2 | * | 11/2002 | Tokai et al. | 430/321 |

FOREIGN PATENT DOCUMENTS

WO WO 0072350 11/2000

* cited by examiner

*Primary Examiner*—Kenneth J. Ramsey
(74) *Attorney, Agent, or Firm*—Kevin D. Wills; William E. Koch

(57) ABSTRACT

A field emission display (30) having an anode plate (10) that has phosphor channels (13, 14, 15). The phosphor channels (13, 14, 15) are formed by depositing a first layer of photosensitive film (58) on a substrate (11). Stripes are patterned into the first layer photosensitive film (58) using ultraviolet light. A second layer of photosensitive film (59) is formed on the first layer of photosensitive film (58). Stripes are patterned into the second layer of photosensitive film (59) using ultraviolet light. The stripes in the second layer of photosensitive film (58) are substantially perpendicular to the first layer of photosensitive film (59). Both layers of photosensitive film are developed to form channel structures. Phosphor is formed in the channel structures to form the phosphor channels (13, 14, 15). The anode plate (10) is coupled to a cathode plate (31) to form the field emission display (30).

20 Claims, 2 Drawing Sheets

FIELD EMISSION DISPLAY AND METHOD OF MANUFACTURE

FIELD OF THE INVENTION

The present invention relates, in general, to field emission displays and, more particularly, to an anode plate for a field emission display and methods of manufacturing the anode plate.

BACKGROUND OF THE INVENTION

Anode plates of field emission displays are comprised of a thick film system with individual "via-like" subpixels which hold phosphor. Phosphor is typically screen printed as a phosphor paste directly into each subpixel and subsequently fired. Unfortunately, due to the feature size of a typical sub-pixel, screen printing a phosphor paste is difficult and usually results in pinholes and poor phosphor uniformity. Pinholes occur due to the small feature size of the subpixel with respect to the silk screens. Poor phosphor uniformity occurs due to the nature of screen printing over a small well structure. More particularly, the phosphor paste at the beginning of the well structure will be thin and the phosphor paste at the end of the well structure will be thick.

Accordingly, it would be advantageous to have a method for manufacturing a field emission display wherein the phosphor layer is free of pinholes and has a uniform thickness.

BRIEF DESCRIPTION OF THE DRAWINGS

For simplicity and clarity of illustration, elements in the drawings are not necessarily drawn to scale, and the same reference numerals in different figures denote the same elements.

DETAILED DESCRIPTION OF THE DRAWINGS

Generally, the present invention provides a field emission display and a method for manufacturing the field emission display such that it has an anode structure that includes channels into which a phosphor paste is disposed. The channels containing the phosphor material may be referred to as phosphor channels. The channels allow formation of pinhole free phosphor films of uniform thickness in a cost efficient manner.

Figure 1:
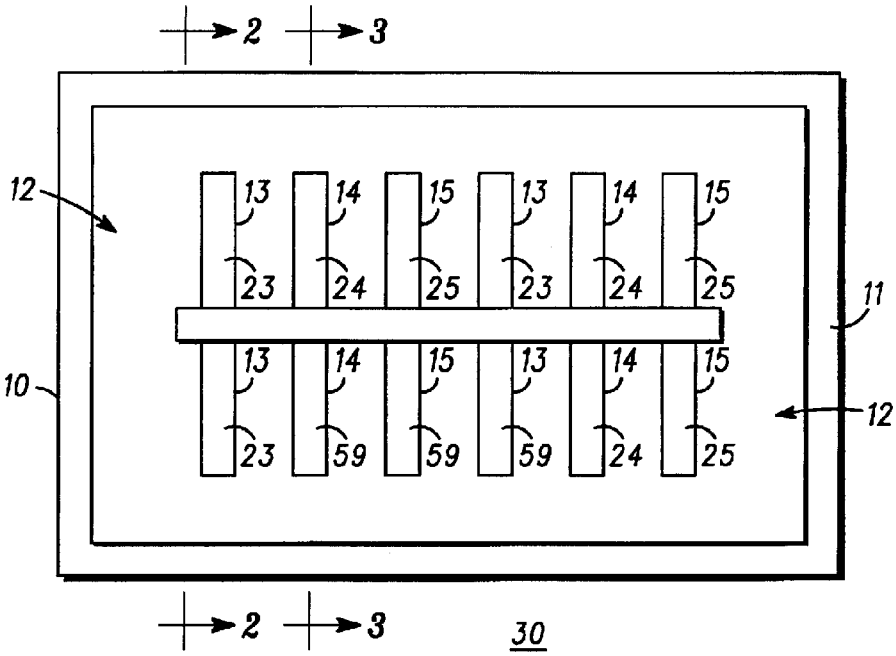
FIG. 1 is a bottom plan view of an anode plate for a field emission display in accordance with an embodiment of the present invention.

FIG. 1 is a bottom plan view of an anode plate 10 for a field emission display 30 in accordance with an embodiment of the present invention. Anode plate 10 includes a substrate 11, which is made of a hard, transparent material, such as glass, quartz, or the like.

A channel structure 12 is formed on substrate 11 from a plurality of photosensitive layers. Channel structure 12 defines a plurality of phosphor channels 13, 14, and 15, which contain the cathodoluminescent phosphors. The embodiment of FIG. 1 is described as a polychromatic display; however, this is not intended as a limitation of the present invention. That is, the present invention may be a monochromatic display. So, in accordance with this embodiment of the present invention, the phosphor material includes a red phosphor 23, a green phosphor 24, and a blue phosphor 25, which define a plurality of pixels. By way of example, and no way intended to be limiting, the dimensions of phosphor channels 13, 14, and 15 are about 75 micrometers wide dependent on the size of the display and about 10 micrometers deep.

Figure 2:
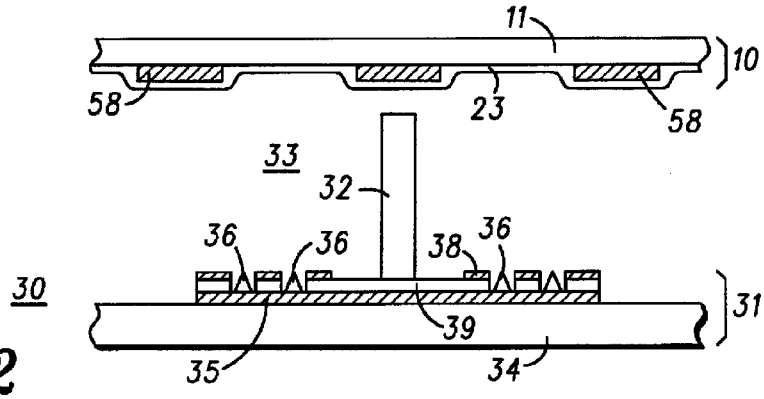
FIG. 2 is a cross-sectional view of the field emission display taken along section line 2—2 of FIG. 1.

FIG. 2 is a cross-sectional view of field emission display 30 taken along section line 2—2 of FIG. 1. Field emission display 30 includes anode plate 10 and a cathode plate 31, which opposes anode plate 10. Cathode plate 31 is spaced apart from anode plate 10 by spacers 32 to define an interspace region 33 therebetween. One of the opposing edges of spacer 32 contacts one of the spacer regions of channel structure 12, and the other opposing edge of spacer 32 contacts cathode plate 31. Cathode plate 31 includes a substrate 34, upon which are formed a cathode electrode 35 and a plurality of electron emitters 36. Electron emitters 36 oppose phosphor channels 13, 14, and 15. It should be noted that only phosphor channel 13 is shown in FIG. 2.

Channel structure 12 has a plurality of channel walls 16, which define phosphor channels 13, 14, and 15. The phosphor material is disposed within phosphor channels 13, 14, and 15. Preferably, the depth of each of phosphor channels 13, 14, and 15 is greater than the depth of phosphor 23, 24, and 25 disposed therein, respectively. This configuration provides an exposed portion of channel walls 16. The exposed portions of channel walls 16 provide many advantages. For example, for a given phosphor thickness, a greater via depth provides greater shielding of the phosphor material from the electric field. This is due to the conductive characteristic of channel structure 12. The depth of phosphor channels 13, 14, and 15 is equal to the thickness of conductive channels 13, 14, and 15, which is about 10–12 micrometers.

Figure 3:
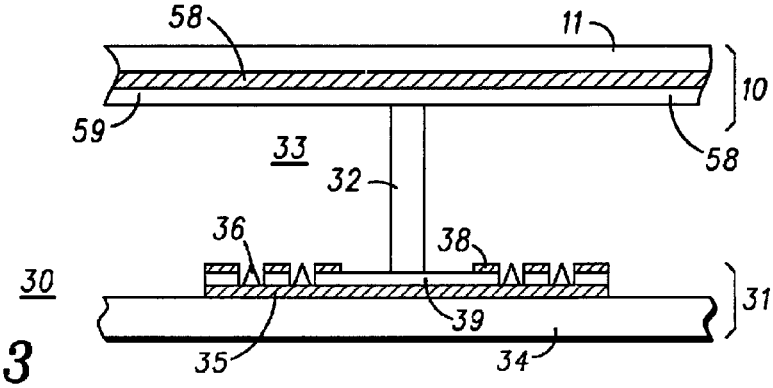
FIG. 3 is a cross-sectional view of the field emission display taken along section line 3—3 of FIG. 1.

FIG. 3 is a cross-sectional view of field emission display 30 taken along section line 3—3 of FIG. 1. FIG. 3 illustrates spacers 32 and photosensitive films 58 and 59 as further described hereinbelow.

Figure 4:
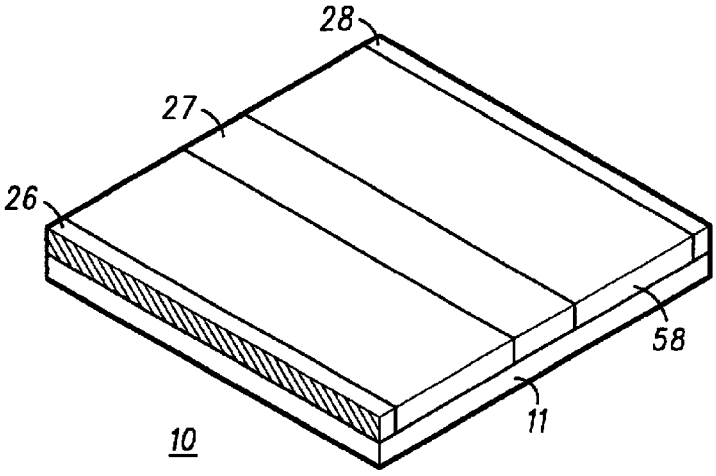
FIG. 4 is an isometric view of an anode plate at an early stage of manufacture in accordance with an embodiment of the present invention.

Now referring to FIG. 4, an isometric view of a portion of anode plate 10 at an early stage of manufacture in accordance with an embodiment of the present invention is illustrated. Anode plate 10 includes substrate 11, which can be made from a hard transparent material such as, for example, glass, quartz, or the like. A photosensitive film 58 is disposed on the surface of substrate 11. By way of example, photosensitive film 58 is made using a conductive photo-printable material, which is available from E.I. du Pont de Nemours and Company of Wilmington Del., and sold under the trademark FODEL. The FODEL is a mixture including glass, silver metal, and a photosensitive polymer. The glass constituent has a bonding (e.g., melting, sintering) temperature less than about 600 degrees Celsius (° C.). The silver composition of the FODEL ranges up to about 95 per cent by weight. The concentration of the photo-sensitive polymer is sufficient to impart photo-sensitivity to the dried FODEL film, so that it may be photo-patterned.

Photosensitive film 58 further includes a contrast enhancement material, such as ruthenium oxide, nickel oxide, or the like which is admixed to the FODEL paste in an amount sufficient to form a black paste. The photosensitive film 58 is then light absorbing, so that it enhances the contrast of the display image. The black paste is then silk screened onto the dry surface of substrate 11 to form a black film. The black film has a thickness within a range of about 1.5 to 5 micrometers. Substrate 11 is then placed in a low temperature oven, and the black film is dried by heating at about 80° C. for about 20 minutes.

The dried film is then exposed to radiation such as, for example; collimated ultraviolet (UV) light, through a mask. The regions of the film that are to be removed are not exposed to the UV light. In accordance with one embodiment of the present invention, a plurality of rectangularly shaped regions or stripes 26, 27, and 28 are exposed to the UV light. Rectangularly shaped regions 26, 27, and 28 are parallel to and spaced apart from one another. Regions 26, 27, and 28 are indicated in FIG. 4 by cross-hatches in photosensitive film 58. Although three exposed rectangularly shaped regions are shown in FIG. 4, the number of rectangularly shaped regions is not a limitation of the present invention.

Figure 5:
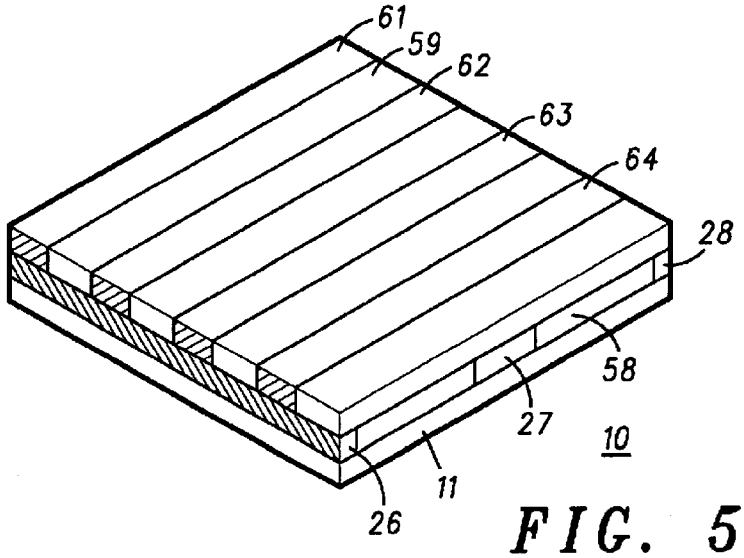
FIG. 5 is an isometric view of the anode plate of FIG. 4 further along in manufacture.

Now referring to FIG. 5, another photosensitive film 59 is disposed on the photosensitive film 58. By way of example, photosensitive film 59 is made using a conductive photo-printable material such as, for example, FODEL. The silver composition of the FODEL ranges up to 95 percent by weight. The concentration of the photo-sensitive polymer is sufficient to impart photo-sensitivity to the dried FODEL film, so that it may be photo-patterned. By way of example, the thickness of photosensitive film 59 ranges from about 3 to about 8 micrometers. Substrate 11 is then placed in a low temperature oven, and the photosensitive film 59 is dried by heating at about 80° C. for about 20 minutes.

The dried film is then exposed to radiation such as, for example, collimated UV light through a mask. The regions of the film that are to be removed are not exposed to the UV light. In accordance with this embodiment of the present invention, a plurality of rectangularly shaped regions or stripes 61, 62, 63, and 64 are exposed to the UV light. Rectangularly shaped regions 61, 62, 63, and 64 are spaced apart from one another. Regions 61, 62, 63, and 64 are indicated in FIG. 2 by cross-hatches in photosensitive film 59. It should be noted that the unexposed portions of photosensitive film 58 that are between substrate 11 and exposed regions 61, 62, 63, and 64 also become exposed during the exposure of photosensitive film 59.

Figure 6:
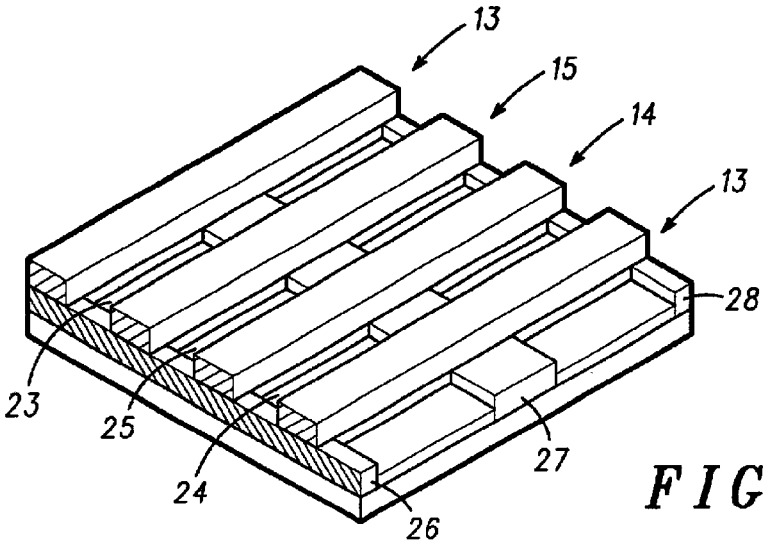
FIG. 6 is an isometric view of the anode plate of FIG. 5 further along in manufacture.

Now referring to FIG. 6, photosensitive films 58 and 59 are developed using a sodium bicarbonate solution having a pH of about 11. The developing step causes the unexposed regions of photosensitive films 58 and 59 to be removed, thereby forming channels 13, 14, and 15. In other words, developing photosensitive layers 58 and 59 results in the formation of a pair of light absorbing strips disposed on the substrate, wherein the pair of light absorbing strips are spaced apart from each other and substantially parallel to each other. The developing step further forms a pair of conductive ribs disposed over the pair of light absorbing strips, wherein the pair of conductive ribs are spaced apart from each other, substantially parallel to each other, and substantially perpendicular to the pair of light absorbing strips, and wherein the pair of light absorbing strips and the pair of conductive ribs cooperate to form a channel. The resulting structure is then baked in an appropriate atmosphere to decompose the photo-sensitive polymer and bond the glass constituent, thereby forming a cohesive structure that is affixed to substrate 11. By way of example, the resulting structure is baked in air at a temperature of about 520° C. for about 55 minutes. The times, temperatures, and atmosphere in which the resulting structure is baked is not a limitation of the present invention.

Photosensitive films 58 and 59 have been described as negative photosensitive films, however, it should be understood this is not a limitation of the present invention. In other words, photosensitive films 58 and 59 can be positive photosensitive films or a combination of positive and negative photosensitive films.

As those skilled in the art are aware, fiducials are typically formed at the develop step. The fiducials serve as alignment features when aligning two photomasks. Since two photomask steps are performed but there is only a single develop step, mechanical fiducials or alignment features (not shown) are formed on substrate 11. By way of example, the alignment feature or fiducial is a rectangular shaped glass or ceramic material bonded to substrate 11.

Subsequent to the affixation of photosensitive films 58 and 59 to substrate 11 , phosphors 23, 24, and 25 are deposited into phosphor channels 13, 14, and 15, respectively, by one of several phosphor deposition methods, which are known to one skilled in the art. An exemplary screen printing process for the deposition of phosphors 23, 24, and 25 includes using a patterned screen to deposit the phosphor material directly into phosphor channels 13, 14, and 15. If a fine pixel pitch is desired, a photo-sensitive polymer binder can be added to the phosphor materials. Then the different color phosphor materials are sequentially silk screened, photo-imaged, and developed. Thereafter, substrate 11 is heated at about 450° C. for about one hour to burn off the photo-sensitive binder.

In accordance with the present embodiment, an aluminum overlayer (not shown) is formed on the phosphor material. Methods for forming the aluminum overlayer are known to those skilled in the art. It should be understood that formation of an aluminum overlayer is optional. Omission of the aluminum overlayer precludes the attenuation of the energy of the incident electrons, which otherwise would occur upon their traversal of the aluminum overlayer.

Referring again to FIG. 2, the electrodes of field emission display 30 include cathode electrode 31 a gate extraction electrode 38, and phosphor channels 61, 62, 63, and 64. Gate extraction electrode 35 is spaced apart from cathode electrode 31 by a dielectric layer 39. Each electrode is designed to receive a potential from a potential source (not shown). During the operation of field emission display 30, potentials are applied to effect electron emission from selected ones of electron emitters 36, in a manner known to one skilled in the art. The emitted electrons traverse interspace region 33 to be received by the opposing phosphors 23, 24, or 25, thereby illuminating the corresponding pixel.

By now it should be appreciated that a field emission display having an anode plate with phosphor channels and a method of manufacturing the field emission display have been provided. The anode structure is patterned with a thin black surround matrix that is coupled with "ribs" of conductive material running parallel to the long edge of the phosphor sub-pixels, i.e., the phosphor channels. The phosphor channels can be filled with a phosphor material along the entire length of the anode structure, thus negating any sub-pixel printing and the drawbacks associated with this type of printing. For example, pinholes will not be formed in the phosphor material and it will have improved uniformity. Further, the anode structure of the present invention will be more cost efficient to manufacture.

While specific embodiments of the present invention have been shown and described, further modifications and improvements will occur to those skilled in the art. It is understood that the invention is not limited to the particular forms shown and it is intended for the appended claims to cover all modifications which do not depart from the spirit and scope of this invention. For example, a white paste containing a gas-absorption material may be formed on photosensitive film 59. Further, different types of alignment features may be formed on substrate 11.

What is claimed is:

1. A method for manufacturing a field emission display, comprising:

providing a cathode plate having a plurality of electron emitters;

providing an anode plate, wherein providing the anode plate comprises:

providing a substrate having a first film disposed thereon, the substrate having a first edge opposite a second edge and a third edge opposite a fourth edge;

forming a first exposed portion defining first channels substantially parallel to the first edge of the first film;

disposing a second film on the first film;

forming a second exposed portion defining second channels substantially parallel to the third edge of the second film;

developing the first and second films, wherein the first and second exposed portions are fixed to the substrate and portions of the substrate are uncovered; and disposing phosphor into the second channels on the uncovered portions of the substrate; and coupling the anode plate to the cathode plate.

2. The method of claim 1, wherein the substrate is selected from the group of glass and quartz.

3. The method of claim 1, wherein the first film comprises a photosensitive film .

4. The method of claim 3, wherein the first film comprises a photosensitive black paste.

5. The method of claim 4, wherein the photosensitive black paste contains up to 20% silver by weight.

6. The method of claim 4, wherein the photosensitive black paste comprise an oxide selected from the group ruthenium oxide and nickel oxide.

7. The method of claim 3, wherein forming a first exposed portion includes exposing the first film to radiation.

8. The method of claim 3, wherein forming the first exposed portion includes forming a plurality of first exposed portions spaced apart from one another and substantially parallel to the first edge.

9. The method of claim 1, wherein the second film comprises a photosensitive material.

10. The method of claim 1, wherein the photosensitive material comprises silver.

11. The method of claim 1, wherein disposing the phosphor includes screen printing the phosphor onto the uncovered portions of the substrate.

12. The method of claim 1, further including forming an alignment feature on the substrate.

13. The method of claim 12, wherein forming the alignment feature comprises coupling a material to the substrate, the material selected from one of ceramic, glass, plastic.

14. A method for manufacturing a flat panel display, comprising:

providing a substrate having a first photosensitive layer disposed thereon;

exposing a first portion of the first photosensitive layer to radiation to define first channels;

disposing a second photosensitive layer on the first photosensitive layer;

exposing a first portion of the second photosensitive layer to radiation to define second channels substantially orthogonal to the first channels;

developing the exposed first portions of the first and second photosensitive layers to uncover a portion of the substrate; and disposing a phosphor paste into the second channels on the uncovered portion of the substrate.

15. The method of claim 14, wherein the first photosensitive layer is a photosensitive black paste comprising an oxide selected from the group ruthenium oxide and nickel oxide.

16. The method of claim 14, wherein the second photosensitive layer comprises a photosensitive silver paste.

17. The method of claim 14, wherein exposing the first portion of the second photosensitive layer includes exposing at least two rectangular stripes that are substantially parallel to one another and substantially perpendicular to the exposed first portions of the first photosensitive layer.

18. The method of claim 14, wherein developing the exposed first portions of the first and second photosensitive layers includes forming a channel structure in the first and second photosensitive layers.

19. The method of claim 14, further including forming a fiducial on the substrate that allows alignment for exposing the first portion of the second photosensitive layer.

20. The method of claim 14, further including coupling a cathode plate to the substrate.

* * * * *